United States Patent [19]

Russel

[11] Patent Number: 4,477,176

[45] Date of Patent: Oct. 16, 1984

[54] APPARATUS FOR PRODUCING MULTIPLE IMAGE SIMPLEX AND DUPLEX COPIES IN A SINGLE PASS

[75] Inventor: Matthew J. Russel, Rochester, N.Y.

[73] Assignee: Eastman Kodak Company, Rochester, N.Y.

[21] Appl. No.: 566,010

[22] Filed: Dec. 27, 1983

[51] Int. Cl.[3] ..... G03G 15/00; G03G 13/16; G03G 13/00; G03G 15/01

[52] U.S. Cl. ..... 355/3 TR; 355/4; 355/7; 355/3 SH; 355/14 TR; 271/9; 271/186; 430/42; 430/126

[58] Field of Search ..... 355/3 TR, 4, 14 TR, 355/3 SH, 23, 26, 3 R, 16, 7, 11; 271/9, 186; 430/126, 42, 54, 74, 75, 91; 335/24; 118/638, 235; 415/121 A; 106/307; 252/501.1; 524/110, 82; 101/177, 246, 409, 426

[56] References Cited

U.S. PATENT DOCUMENTS

| | | | |
|---|---|---|---|
| 2,807,233 | 9/1957 | Fitch | 355/7 X |
| 3,612,677 | 10/1971 | Langdon | 355/4 |
| 3,615,414 | 10/1971 | Light | 430/74 |
| 3,690,756 | 9/1972 | Smith | 355/4 |
| 3,707,138 | 12/1972 | Cartwright | 430/54 X |
| 4,095,979 | 6/1978 | DiFrancesco et al. | 355/3 R X |
| 4,191,465 | 3/1980 | Boase et al. | 355/3 SH |
| 4,251,154 | 2/1981 | Russel | 355/14 TR X |

*Primary Examiner*—J. V. Truhe
*Assistant Examiner*—Terry Flower
*Attorney, Agent, or Firm*—William F. Noval

[57] ABSTRACT

Reproduction apparatus for producing multiple image simplex copies and/or duplex copies in a single pass of a copy sheet through the apparatus. The reproduction apparatus includes a movable imaging member upon which at least first and second transferable images are carried. Transfer apparatus is provided for transferring the transferable images from the imaging member to a copy sheet. A copy sheet positioning assembly is operable in synchronism with the movable imaging member and the transfer apparatus in first and second modes. In the first mode, the positioning assembly positions one side of a copy sheet in transferable relationship with the movable imaging member at the transfer apparatus to successively transfer the first and second transferable images to one side of the copy sheet. In the second mode, the positioning assembly positions a copy sheet in transferable relationship with the movable imaging member at the transfer apparatus to successively transfer the first and second transferrable images to respective opposite sides of the copy sheet.

8 Claims, 3 Drawing Figures

APPARATUS FOR PRODUCING MULTIPLE IMAGE SIMPLEX AND DUPLEX COPIES IN A SINGLE PASS

BACKGROUND OF THE INVENTION

In the field of reproduction apparatus, the trend has been to incorporate more and more features into a single apparatus to increase its capability of handling a greater variety of copying jobs. Thus it has been proposed to provide electrophotographic apparatus which produces either single image simplex or single image duplex copies during a single pass of the copy sheet through the electrophotographic apparatus. Such an apparatus, for example, is disclosed in commonly assigned U.S. Pat. No. 4,191,465 issued Mar. 4, 1980, for "Apparatus for Producing Simplex Or Duplex Copies," by E. E. Boase et al. It has also been proposed to provide electrophotographic color copiers in which multiple images are transferred in registration to one side of a copy sheet during a single pass of the copy sheet through the copier. Such a copier, for example, is disclosed in commonly assigned U.S. Pat. No. 4,251,154 issued Feb. 17, 1981, for "Electrophotographic Color Copier," by M. J. Russel. As disclosed, the apparatus includes a movable image transfer member adapted to receive related transferable color separation images in non-overlapping image areas, and a transfer mechanism mounted adjacent to the image transfer member to transfer the separation images into registration onto one side of a copy sheet. The copier includes register rollers disposed between adjacent transfer stations which remove a copy sheet from contact with the image transfer member and return it in registration with the next image on the transfer member at the next transfer station. Instead of the multiple transfer stations and multiple register rollers disclosed in the latter patent, it has also been proposed to use a single copy roller and single transfer station for multiple image transfer to a single copy sheet. Thus, in U.S. Pat. No. 3,690,756 issued Sept. 12, 1972, for "Color Xerography," by W. A. Smith, an embodiment of color copier is disclosed in FIG. 4 in which a sequence of color separation images of the same original are formed on a photoconductive belt and the images sequentially transferred in registration to a sheet of support material by means of a copy roller and corona transfer device. Although the devices disclosed in these patents may be suitable for the uses for which they are intended, there has been a need for reproduction apparatus which is capable of not only producing single-image simplex or duplex copies of an original during a single pass of a copy sheet through the apparatus, but which is also capable of forming multiple images of an original on a copy sheet in either the simplex or duplex mode during a single pass.

SUMMARY OF THE INVENTION

According to the present invention, there is provided reproduction apparatus comprising a movable imaging member upon which at least first and second transferable images are carried. The apparatus includes transfer means for transferring said transferable images from said imaging member to a copy sheet and positioning means operable in synchronism with said movable imaging member and said transfer means in either a multi-image simplex mode or a duplex mode. In the multi-image simplex mode, one side of a copy sheet is positioned by positioning means in transferable relationship with said movable imaging member at said transfer means to successively transfer the first and second transferable images to one side of the copy sheet. In the single-pass duplex mode, a copy sheet is positioned by said positioning means in transferable relationship with said movable member at said transfer means to successively transfer said first and second images to respective opposite sides of said copy sheet.

The invention and its objects and advantages will become more apparent in the detailed description of the preferred embodiment presented below.

BRIEF DESCRIPTION OF THE DRAWINGS

In the detailed description of the preferred embodiments of the invention, reference is made to the accompanying drawings, like numbers representing like elements, in which.

DESCRIPTION OF THE PREFERRED EMBODIMENTS

Figure 1:
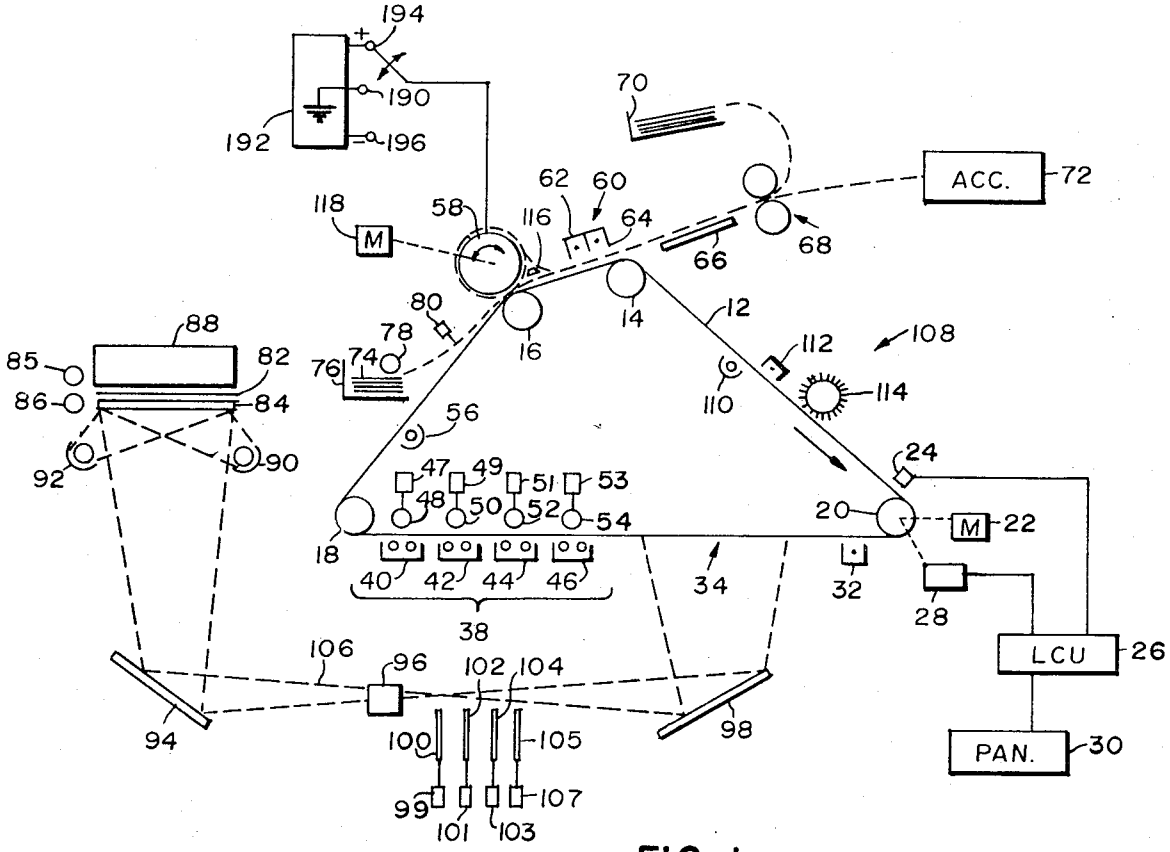
FIG. 1 is a diagrammatic view of one embodiment of reproduction apparatus according to the present invention.

Referring now to FIG. 1, there is shown one embodiment of reproduction apparatus according to the present invention. The apparatus is operable in different modes to produce either single-image simplex copies, single-image duplex copies, or multiple-image simplex copies or multiple-image/single-image duplex copies during a single pass of a copy sheet through the apparatus. As shown, reproduction apparatus 10 includes an endless image transfer member such as photoconductive belt 12. Belt 12 (which may be of the type described in U.S. Pat. No. 3,615,414 issued Oct. 26, 1971, in the name of Light), is rotatably supported on rollers 14, 16, 18, and 20 which are journaled in the copier frame. Belt 12 is driven in a clockwise direction by means of motor 22. Belt 12 has a plurality of sequentially spaced, non-overlapping image areas disposed about it which successively pass electrophotographic processing stations (charge, expose, develop, transfer, clean) located about the periphery of belt 12. Belt 12 also has timing marks (such as regularly spaced perforations) which are sensed by appropriate means such as timing signal generator 24 to produce timing signals which are supplied to a logic and control unit (LCU) 26. LCU 26 includes a microprocessor such as the model 8085 microprocessor available from the Intel Corporation of Santa Clara, Calif. Encoder 28 associated with drive motor 22 also produces timing signals for LCU 26 which are used in conjunction with the timing signals produced by generator 24 to control the operation of reproduction apparatus 10. Control and display panel 30 connected to LCU 26 has operator selectable switches for programming the operation of reproduction apparatus 10 and has operator observable displays which inform the operator of the selected functions and other useful information.

Reproduction apparatus 10 is operable in a plurality of copying modes. In one mode, a single-image is produced on one side of a copy sheet in a single-pass through the reproduction apparatus. In another mode, single-images are produced on opposite sides of a copy sheet during a single pass through the apparatus. In a third mode, multiple images are formed on a single side of a copy sheet during a single pass of the sheet through the apparatus, and in a fourth mode, multiple images are formed on one side of a copy sheet and a single image is formed on the other side of the copy sheet during a single pass of the copy sheet through the apparatus. In order to effect these modes, reproduction apparatus 10 includes a series of processing stations located about photoconductive belt 12. As described in the above-mentioned U.S. Pat. No. 3,615,414, belt 12 includes a photoconductive insulating layer and a conductive layer in conductive contact with the insulating layer. The photoconductive layer of belt 12 is initially charged with an electrostatic charge of a first polarity by means of a corona charging electrode 32. An exposure station 34 is provided to expose charged image areas of belt 12 to a radiation image of an original. Upon exposure, the photoconductive layer is selectively discharged in an image-wise manner to produce a latent electrostatic image corresponding to the original image.

The electrostatic latent is then developed at development station 38 in FIG. 1 which includes a plurality of magnetic brush toning stations 40, 42, 44, and 46, which selectively develop the image with toner particles having an opposite charge to the latent electrostatic image. The toner particles of each of the stations are of a different color, e.g., station 40 is provided with cyan toner particles; station 42 is provided with magenta toner particles; station 44 is provided with yellow toner particles and station 46 is provided with black toner particles. Backup rollers 48, 50, 52, and 54 are selectively moved to deflect belt 12 into operative engagement with respective magnetic brush toning stations 40, 42, 44, and 46. Alternatively, rollers 48, 50, 52, and 54 may be stationary and development stations 40, 42, 44, and 46 selectively moved into and out of operative relationship with belt 12.

A post-development erase lamp 56 reduces the electrostatic attraction between the toner image and belt 12 to facilitate transfer to a copy sheet and to reduce photoconductor fatigue.

Copy sheet positioning apparatus includes a relatively conductive roller 58 for use in the multiple-image and single-pass duplexing modes. Roller 58, e.g., may have a cover of rubber which has a resistivity in the order of 10 ohms per cubic centimeter. (See, e.g., U.S. Pat. No. 2,807,233 and commonly-assigned U.S. Pat. No. 3,707,138). Roller 58 is also appropriately biased with a voltage of several hundred to a few thousand volts to function as a first transfer station in these modes. Second transfer station 60 includes corona transfer charger 62 and detack charger 64.

A copy sheet is separated from belt 12 at separating roller 14 and is carried by air transport 66 to roller fuser 68 where the toner image(s) is permanently fixed to the copy sheet. The copy is then delivered either to an output tray 70 or to a copy handling accessory 72 such as a sorter or a finisher.

Copy sheets 74 are supplied successively from supply 76 by means of oscillating vacuum roller 78 to registration mechanism 80 which eliminates skew from a fed sheet 74 and registers sheet 74 with a toner image on belt 12.

Originals 82 to be reproduced are positioned on transparent platen 84 either by feed rollers 85 and 86 or by recirculating document feeder 88, both of which are controlled by LCU 26. Document 82 is illuminated by flash lamps 90 and 92 to produce a radiation image which is projected upon belt 12 at exposure station 34 by means of mirror 94, lens 96, and mirror 98. A plurality of filters such as red filter 100, green filter 102, blue filter 104 are selectively insertable into optical path 106 to Produce color separation images on successive image frames of belt 12. A neutral density filter 105 is also provided to produce a low density background image of black.

A cleaning station 108 is provided to effect mechanical and electrical cleaning of photoconductive belt 12. Station 108 includes a cleaning assist erase lamp 110 which exposes the photoconductor to radiation to further reduce any charge remaining from the detack and transfer steps; a cleaning assist charger 112 which impresses an AC charge on photoconductive belt 12 to neutralize the charges on untransferred toner particles; and a brush 114 which removes any residual toner from belt 12 and deposits it in a suitable collection container (not shown).

When apparatus 10 is operated in a simplex mode, that is, when single images are formed on only one side of copy sheets, a document 82 is moved onto platen 84 by feed rollers 85, 86, or recirculating feeder 88 and a radiation light image is projected onto an electrostatically charged image frame of belt 12 at exposure region 34 to form an electrostatic latent image corresponding to the original. If this latent image is of a business document, such as a letter or the like, it may be developed with black toner or any other colored toner. Thus, filters 100, 102, 104 and 105 are not inserted into optical path 106 and LCU 26 actuates solenoid 53 to move backup roller 54 so that belt 12 engages black magnetic brush toning station 46 to develop the latent electrostatic image with black toner particles. LCU 26 causes feed roller 78 to feed copy sheet 74 to registration mechanism 80 which registers it with the black toner image on belt 12. Roller 58 is connected to grounded terminal 190 of voltage supply 192 and thus does not attract copy sheet 74. Belt 12 is moved out of engagement with roller 58 by movement of roller 16 away from roller 58 (this is effected by suitable means, not shown). Sheet 74 moves with belt 12 to transfer station 60 where transfer charger 62 transfers the black toner image to the one side of copy sheet 74. Detack charger 64 neutralizes the attraction between sheet 74 and belt 12, and sheet 74 separates from belt 12 at separation roller 14 and is transported by air transport 66 to fuser 68 and from there to output tray 70 or copy handling accessory 72. Successive simplex sheets are produced in the same manner.

When apparatus 10 produces duplex copies having single images on opposite sides of a copy sheet, successive latent images are formed on belt 12 as explained above by feeding successive documents to platen 84. Solenoid 53 is actuated to cause backup roller 54 to bring belt 12 into contact with black toning station 46 to develop the successive images into black toner images. Alternatively any of the other toning stations may be actuated to develop the images with the same or different colors. One side of a copy sheet 74 is registered by mechanism 80 with the first toner image on belt 12 in advance of roller 58. Roller 58 is biased to a potential opposite in polarity to the first toner image (e.g., if the first toner image has a negative polarity, roller 58 is connected to positive terminal 194 of voltage source 192). Thus, roller 58 attracts the first toner image to copy sheet 74 and also tacks sheet 74 to roller 58.

After the trailing edge of copy sheet 74 has been separated from belt 12, roller 58 is stopped and its direction of rotation reversed. The polarity of roller 58 is also reversed (e.g., by connecting roller 58 to negative terminal 196 of voltage source 192) to release copy sheet 74 from roller 58. Stripper member 116 may also be provided to assist in separating sheet 74 from roller 58. The other side of sheet 74 is registered with the second toner image on belt 12 at transfer station 60 (belt 12 will have been moved away from roller 58 to permit passage of the second toner image). Transfer charger 62 transfers the second toner image to the opposite side of sheet 74, and detack charger 64 neutralizes the attraction between sheet 74 and belt 12. Sheet 74 separates at roller 14 to be transported to fuser 68 where both toner images are fused to copy sheet 74 to produce a duplex copy. The operation of single pass duplex apparatus is shown and described more completely in commonly assigned U.S. Pat. No. 4,095,979 issued June 20, 1978 for "Method and Apparatus for Producing Duplex Copies," by DiFrancesco et al.

In a third mode of operation, apparatus 10 produces multiple images in superimposed registration on one side of a copy sheet. A multi-colored document 82 (such as a color photograph) is positioned on platen 84 by means of feed rollers 85 and 86 or recirculating document feeder 88. Document 82 is illuminated four times by flash lamps 90 and 92 to form four successive light images which are projected along light path 106 by mirrors 94 and 98 and lens 96. Neutral density filter 105 (for forming a low density black background image), red filter 100, green filter 102, and blue filter 104 are successively inserted into light path 106 through selective actuation by LCU 26 of respective solenoids 107, 99, 101 and 103 to form latent electrostatic separation images of document 82 on belt 12 at exposure station 34. LCU 26 then (1) actuates solenoid 53 to move roller 54 and belt 12 into contact with toning station 46 to develop the black electrostatic latent image with black toning particles; (2) actuates solenoid 47 to move roller 48 and belt 12 into contact with toning station 40 to develop the red electrostatic latent image with complimentary colored cyan toner particles; (3) actuates solenoid 49 to move backup roller 50 and belt 12 into contact with toning station 42 to develop the green electrostatic latent image with complimentary colored magenta toner particles; and (4) actuates solenoid 51 to move backup roller 52 and belt 12 into contact with toning station 44 to develop the blue electrostatic latent image with complimentary colored yellow toner particles.

It will be appreciated that only one backup roller is moved into contact with belt 12 for each image passing development station 38 in FIG. 1 so that only the desired toning station acts to bring the appropriately colored toner particles into contact with the image while the other toning stations are held out of contact with the selected image to be developed. In this manner, the black latent image is developed only with black toner particles; the red latent image is developed only with cyan toner particles, the green latent image is developed only with magenta toner particles, and the blue latent image is developed only with yellow toner particles.

After the toner images have passed post-development erase lamp 56 to reduce the electrostatic bond between the toner image and belt 12, a copy sheet 74 is fed from supply 76 by means of feed roller 78 and registered by mechanism 80 with the first toner image on belt 12 in advance of roller 58. Roller 58 is biased to an opposite polarity to effect transfer of the first toner image to one side of copy sheet 74 and to tack sheet 74 to roller 58. Roller 58 has a compliant surface and engages belt 12 with sufficient pressure relative to the applied bias to effect proper transfer. The circumference of roller 58 is equal to the dimension of one image area of belt 12 (in the direction of web travel) plus the distance between two adjacent areas and is rotated at an angular velocity equal to the linear velocity of belt 12. Roller 58 is driven by stepper motor 118 which receives actuating signals from LCU 26.

It will be understood that roller 58 may also be a biasable vacuum roller or a roller with sheet clamping mechanisms to clamp the sheet to it (see, e.g., U.S. Pat. No. 3,612,677).

Continued movement of belt 12 and synchronized rotation of roller 58 brings the lead edge of copy sheet 74 back into transferable relationship with belt 12 as the lead edge of the next toner image arrives at roller 58. At this point, sheet 74 remains tacked to roller 58 and the second toner image is transferred in superimposed registration with the first toner image on sheet 74. The process is repeated until the second toner image has been transferred to sheet 74 and the leading edge of copy sheet 74 has been brought back into transferable relationship with the third toner image on belt 12 which is transferred in superimposed registration with the other two images on the one side of copy sheet 74. The fourth toner image is transferred last in superimposed registration with the other three images on sheet 74. When the lead edge of copy sheet 74 is brought back into transferable relationship with belt 12 for the last time, the bias on roller 58 is reversed to repel sheet 74 away from roller 58 back into contact with belt 12. Copy sheet 74 will be carried by belt 12 to separation roller 14 and then by air transport 66 to fuser 68. In such case, transfer charger 62 is not activated.

Alternatively, roller 58 may be used to transfer the first three toner images to copy sheet 74 and after the copy sheet comes into registration with the fourth image on belt 12, sheet 74 is separated from roller 58 and the last toner image is transferred by transfer station 60.

Apparatus 10 is operable in a fourth mode to produce a copy having multiple images on one side of a copy sheet and a single image on the other side of the copy sheet. After a plurality of toner images are transferred to one side of a copy sheet by biased roller 58, a final toner image on belt 12 is transferred to the other side of the multi-imaged copy sheet by reversing roller 58 (as in the single-pass duplex mode described above) to bring the other side of sheet 74 into transferable relationship with the final toner image which is transferred at transfer station 60. Sheet 74 is then separated at roller 14 and transported to fuser 68.

Figure 2:
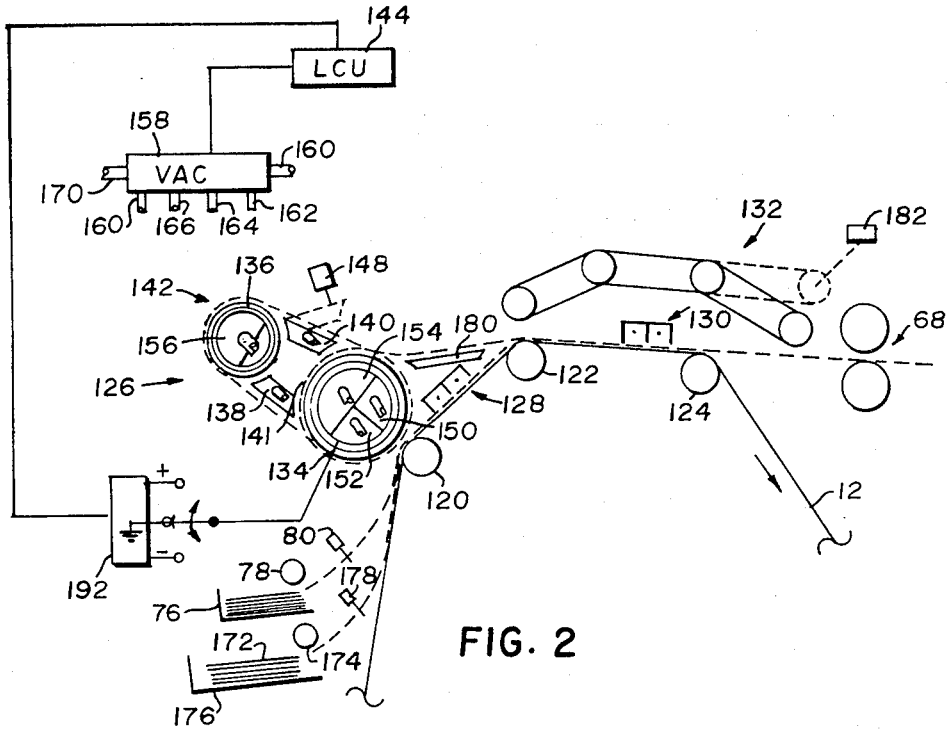
FIG. 2 is a diagrammatic view of another embodiment of the present invention.

Referring now to FIG. 2, there is shown another embodiment of the present invention. As shown in FIG. 2., copy sheets of two widths may be processed by the reproduction apparatus. Thus, for example, apparatus 10 of FIG. 1 has a sheet positioning roller 58 which may be dimensioned to process copy sheets having a maximum dimension of $8\frac{1}{2}$ inches in the direction of sheet movement so that copy sheets of $8\frac{1}{2}\times 11$ inches and $8\frac{1}{2}\times 14$ inches may be processed effectively as well as copy sheets of smaller dimensions. However, where it is desirable to process copy sheets of double page width of $17\times 11$ inches in addition to copy sheets of single page width of $8\frac{1}{2}\times 11$ inches then the size of sheet positioning roller 58 would have to be increased to accommodate the larger size copy sheets.

According to the embodiment shown in FIG. 2, copy sheets of different dimensions are handled efficiently by establishing different sheet paths for different dimensioned copy sheets. As shown, belt 12 is trained about rollers 120, 122, and 124 along which is spaced copy positioning apparatus 126, transfer station 128 and transfer station 130. A vacuum belt conveyor 132 is also provided for shunting a copy sheet around transfer station 130.

Copy sheet positioning apparatus 126 includes first vacuum roller 134 located adjacent to but spaced from roller 120 and belt 12, second vacuum roller 136 spaced from roller 134 and vacuum plenums 138 and 140 located between rollers 134 and 136. Roller 134 is dimensioned to completely remove a copy sheet of a first dimension from contact with belt 12. Thus, if the apparatus of FIG. 2 processes copy sheets having an 8½ inch dimension in the direction of movement of a copy sheet through the apparatus, then the circumference of roller 134 will equal this copy sheet dimension plus an interframe distance between copy sheets. For example, the circumference equals 10 inches for an 8½ inch wide sheet having a 1½ inch interframe distance. One complete revolution of roller 134 moves an 8½ inch copy sheet removed from contact with belt 12 through a first path 141 so that the copy sheet may be repositioned in transferable relationship with a successive toner image on belt 12. The dimensions of vacuum plenums 138 and 140 and roller 136 are such as to define with roller 134, a second path 142 which permits complete removal from belt 12 of a copy sheet of a second dimension such as 17×11 inches.

LCU 144 controls the rotation of rollers 134 and 136 through actuation of stepper motors (not shown). Solenoid 148 moves plenum 140 between a position spaced from path 141 (as shown in dotted lines in FIG. 2) and a position intersecting path 141.

Vacuum roller 134 has internal vacuum plenums 150, 152, and 154 and vacuum roller 136 has internal vacuum plenum 156 which communicates with approximately one half of the circumference of roller 136. Plenums 138, 140, 150, 152, 154, and 156 are connected to vacuum source 158 by means of respective conduits 160, 162, 164, 166, 168 and 170.

The apparatus of FIG. 2, may be operated such that multiple images are formed on one side of a copy sheet having a first dimension. As described above with respect to FIG. 1, a plurality of sequential toner images are formed on belt 12 and one side of a copy sheet of a first dimension is fed from supply 76 by roller 78 and registered with a first toner image on belt 12 by registration mechanism 80. Roller 134 is rotated in a counterclockwise direction and is biased by voltage source 171 to transfer the first toner image from belt 12 to one side of copy sheet 74 which is also tacked to roller 134 by means of vacuum applied to chamber 150 thereof. Plenum 140 has been moved by solenoid 148 out of intersection with path 141 so that as roller 134 rotates, vacuum applied to plenums 152 and 154 move sheet 74 around first path 141 back into transferable relationship with the second toner image on belt 12. This process is repeated for all but the last image. Thus if four toner images are to be transferred in superimposed relationship to one side of copy sheet 74, then three toner images would be transferred by roller 134. As the fourth toner image on belt 12 approaches roller 134, LCU 26 terminates the vacuum applied to plenum 150 by source 158 so that copy sheet 74 is detached from roller 134 and is brought into registration with the fourth toner image on belt 12. The fourth image is transferred at transfer station 128. Vacuum conveyor 132 separates copy sheet 74 from belt 12 at roller 122, shunts sheet 74 around transfer station 130 and delivers it to the nip of fuser 68 where the images are permanently fused to sheet 74.

To produce a copy of a second dimension having multiple images transferred to one side thereof, plenum 140 is moved to the solid-line position of FIG. 2. Source 158 applies vacuum to plenums 150, 152, 140, 138, and 156 but not to plenum 154. A copy sheet 172 of a second dimension is fed by roller 174 from supply 176 and registered by registration 178 with a toner image of the second dimension on belt 12. Vacuum roller mechanism 134 removes sheet 172 from belt 12 and in synchronism with roller 136 moves it around path 143 back into registration with the next toner image on belt 12. The process is repeated until the last toner image on belt 12 approaches roller 134. At this point, the vacuum to plenum 150 is terminated so that copy sheet 172 is brought into registration with the last toner image on belt 12 which is transferred at transfer station 128 in superimposed relationship with the other toner images on copy sheet 172. Thereafter, conveyor 132 removes copy sheet 172 from contact with belt 12, shunts it around transfer station 130 and delivers it to fuser 68.

The apparatus of FIG. 2 may also be operated in a single-pass duplex mode to process copies of the first dimension. In such mode, first and second toner images are formed on belt 12 and the first side of copy sheet 74 is brought into registration with the first toner image on belt 12. Vacuum source 158 applies vacuum to plenums 150, 152, 154 of roller 134 and voltage source 171 applies a voltage of a polarity opposite in polarity to the first toner image. The first toner image is thus transferred to the first side of copy sheet 74 which is drawn to roller 134. Plenum 140 is moved out of path 141 by solenoid 148. After sheet 74 has been separated from belt 12, the direction of rotation of roller 134 is reversed and copy sheet 74 is separated from roller 134 by guide 180 which guides the copy sheet over transfer station 128 into registration with the second toner image on belt 12 at transfer station 130. The second toner image is transferred to the other side of copy sheet 74 at station 130 and sheet 74 is separated from belt 12 at roller 124 to be transported to fuser 68. The end of conveyor 132 is moved out of the path of sheet 74 by means of solenoid 184 to the dashed position shown in FIG. 2.

In another mode of operation of the apparatus of FIG. 2, multiple toner images are transferred to one side of copy sheet 74 and a single toner image to the second side thereof. A plurality of sequential toner images are formed on belt 12 and all but the last toner image is transferred to one side of copy sheet 74 brought into transferable relationship with belt 12. Roller 134 separates copy sheet 74 from belt 12 and recycles it around path 141 until the last toner image approaches transfer station 130. Roller 134 is then reversed and the second side of copy sheet 74 is moved over guide 180 and brought into registration with the last toner image on belt 12 to be transferred by transfer station 130 to the other side of copy sheet 74. Thereafter, the copy sheet is separated from belt 12 at roller 124 and transported to fuser station 68.

Figure 3:
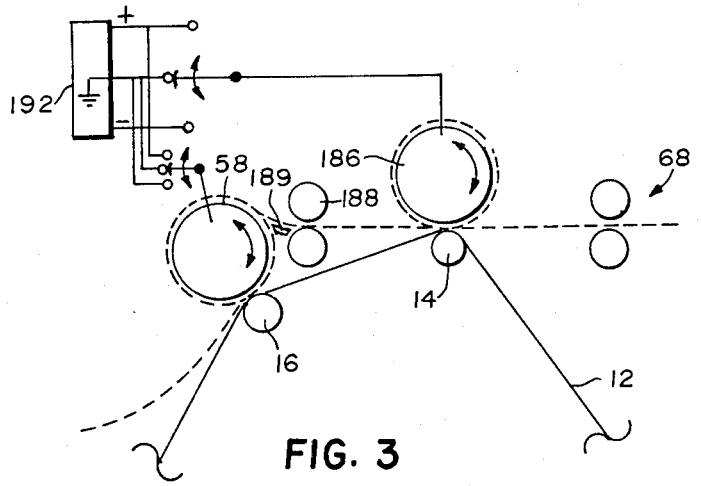
FIG. 3 is a diagrammatic view of another embodiment of the present invention.

Referring now to FIG. 3, there is shown another embodiment of the present invention in which multiple toner images are transferred to both sides of a copy sheet during a single pass of the sheet through the apparatus. The apparatus of FIG. 3 is similar to the apparatus of FIG. 1 except that transfer and detack station 60 is replaced by a second biased vacuum roller 186 and a second fuser 188. In the apparatus of FIG. 3, two sets of multiple toner images are formed on belt 12 by image-forming the process of the apparatus of FIG. 1. The first set of toner images are transferred to one side of a copy sheet 74 by roller 58. Roller 58 is reversed and guide 190 separates sheet 74 from roller 58 and guides it to the nip of roller fuser 188 which fuses the first set of toner images to one side of sheet 74. The fusing may be just sufficient to tack the toner images to sheet 74. Sheet 74 is then transported back into transferable relationship with the first toner image of the second set of multiple images on belt 12. Roller 186 then separates sheet 74 from belt 12 and the second set of images are transferred to the other side of sheet 74 in superimposed relationship. Thereafter, the sheet is separated from roller 176 and belt 12 and transported to fuser 68.

The invention has been described in detail with particular reference to a preferred embodiment thereof but it will be understood that variations and modifications can be effected within the spirit and scope of the invention.

What is claimed is:

1. Reproduction apparatus comprising:

a movable imaging member upon which at least first and second transferable images are carried;

transfer means for transferring said transferable images from said imaging member to a copy sheet; and positioning means operable in synchronism with said movable imaging member and said transfer means (1) in a first mode for positioning one side of a copy sheet in transferable relationship with said movable member at said transfer means to successively transfer said first and second transferable images to said one side of said copy sheet and (2) in a second mode for positioning a copy sheet in transferable relationship with said movable member at said transfer means to successively transfer said first and second images to respective opposite sides of said copy sheet.

2. The reproduction apparatus of claim 1 wherein said transfer means includes first and second transfer stations spaced along said imaging member and wherein said positioning means includes a copy sheet handling assembly which is (1) operable in said first mode to remove said copy sheet from said imaging member after transfer of said first image by said first transfer station to said one side of said sheet and to position said one side in transferable relationship with said imaging member at said first transfer station to receive said second transferable image on said one side and (2) operable in said second mode to remove said copy sheet from said imaging member after transfer of said first image by said first transfer station to said one side of said sheet and to position said other side of said sheet in transferable relationship with said imaging member at said second transfer station to receive said second transferable image on said other side.

3. The reproduction apparatus of claim 2 wherein said sheet handling assembly includes an endless member which is movable in opposite directions and wherein said first transfer station includes means for biasing said endless member to effect transfer of said transferable images.

4. The reproduction apparatus of claim 3 wherein said endless member includes a conductive roller.

5. Reproduction apparatus comprising:

an image transfer member carrying at least first and second transferable toner images;

first and second spaced electrostatic transfer means located along said image transfer member for transferring transferable images from said image transfer member; and a copy sheet handling assembly located adjacent to said image transfer member and associated with said first image transfer means, said sheet handling means being operable in a first mode to remove said copy sheet from said image transfer member after transfer of said first toner image by said first transfer means to one side of a copy sheet and to position said one side in transferable relationship with said image transfer member at said first transfer means so that said second toner image is transferred to said one side of said sheet by said first transfer means and (2) in a second mode to remove said copy sheet from said image transfer member after transfer of said first toner image to one side of said copy sheet by said first transfer means and to position said other side of said copy sheet in transferable relationship with said image transfer member at said second image transfer means so that said second toner image is transferred to said other side of said copy sheet by said second transfer means.

6. The reproduction apparatus of claim 5 wherein said image transfer member carries a first set of successive transferable toner images and at least one other transferable toner image and wherein said first and second transfer means and said copy sheet handling means are operable in a third mode to successively transfer said first set of toner images to said one side of said copy sheet and then to transfer said second toner image to the other side of said copy sheet.

7. The apparatus of claim 6 wherein said first set of images are color separation images.

8. The apparatus of claim 5 including means for fusing said toner images to said copy sheet.

* * * * *